US007282639B2

(12) United States Patent
Farmer

(10) Patent No.: US 7,282,639 B2
(45) Date of Patent: Oct. 16, 2007

(54) IGNITION WIRE HAVING LOW RESISTANCE AND HIGH INDUCTANCE

(75) Inventor: Phillip Farmer, Monticello, AR (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/295,957

(22) Filed: Dec. 7, 2005

(65) Prior Publication Data

US 2006/0119460 A1 Jun. 8, 2006

Related U.S. Application Data

(60) Provisional application No. 60/634,025, filed on Dec. 7, 2004.

(51) Int. Cl.
*H01B 7/18* (2006.01)

(52) U.S. Cl. ..... 174/36; 174/105 R; 174/108; 338/214

(58) Field of Classification Search ..... 174/36, 174/105 R, 108; 338/214
See application file for complete search history.

(56) References Cited

U.S. PATENT DOCUMENTS 3,518,606 A * 6/1970 Barker ..... 338/270
4,435,692 A 3/1984 Miyamoto et al. ..... 338/214
4,800,359 A 1/1989 Yukawa et al. ..... 338/214
4,970,488 A 11/1990 Horiike et al. ..... 338/214
5,057,812 A 10/1991 Yukawa et al. ..... 338/66
5,059,938 A 10/1991 Brown ..... 338/66
5,576,514 A 11/1996 Fujimoto et al. ..... 174/110 R
5,824,958 A 10/1998 Higashikozono et al. ..... 174/105 R
5,875,543 A 3/1999 Fujimoto et al. ..... 29/618
6,252,172 B1 6/2001 Tanigawa et al. ..... 174/102 SC

* cited by examiner

*Primary Examiner*—Chau N. Nguyen
(74) *Attorney, Agent, or Firm*—Dickinson Wright PLLC

(57) ABSTRACT

An ignition wire having low resistance and high inductance includes a ferrite core, a coiled wire surrounding the core, and an insulating sheath, where the high voltage ignition wire exhibits a resistance of 130-210 Ohms/ft and an inductance of 44-104 μH. The coiled wire may have a diameter of 0.07-0.11 mm, 110-180 turns/in. and comprises a CuNi-based alloy. The coiled wire is preferably made of a CuNi-based alloy having, by weight, 80-95% Cu and 5-20% Ni. The ferrite core may include a core stranding which includes a ferrite core coating. The ferrite core coating may include, by weight, about 5.0-8.4% carbon, 31.7-37.8 oxygen, 1.5-1.7% copper, 0.6-0.8% aluminum, 0.1-0.2% sulfer, 7.0-11.6% zinc, 2.4-3.3 nickel and the balance iron and minor amounts of impurities.

9 Claims, 1 Drawing Sheet

IGNITION WIRE HAVING LOW RESISTANCE AND HIGH INDUCTANCE

CROSS-REFERENCES TO RELATED APPLICATIONS

This patent application claims priority to U.S. Provisional Patent Application Ser. No. 60/634,025, filed Dec. 7, 2004, which is incorporated herein by reference in its entirety.

BACKGROUND OF THE INVENTION

1. Technical Field

This invention relates generally to ignition wires used with ignition systems and other devices to conduct high voltage pulses, such as those provided to spark plugs and other discharge devices. More specifically, the invention relates to an ignition wire having a ferrite core, a coiled wire around the core and an outer insulating sheath having characteristically low resistance and high inductance.

2. Related Art

Vehicle ignition systems and other devices which utilize an internal combustion engine, or which utilize high voltage pulses to ignite a fuel, commonly require an ignition wire for conducting the high voltage pulses from a voltage source to the intended device, such as from an ignition coil to a spark plug. This ignition wire can include a ferrite core, a coiled wire wound around the core, and an outer insulating sheath surrounding the entire ignition wire.

Several variables can affect the performance of such an ignition wire, including the material compositions of the different components, the relative diameters of the different components, and the number of turns that the coiled wire is wound around the core, to name but a few. Although numerous attempts have been made to optimize various characteristics of the operating performance of such ignition wires for various applications, there remains a need to improve certain aspects of this performance.

SUMMARY OF THE INVENTION

One aspect of the invention is a high voltage ignition wire having a ferrite core, a coiled wire surrounding the core, and an insulating sheath surrounding both the core and the wire, where the high voltage ignition wire exhibits a resistance of 130-210 ohms/ft.

According to another aspect of this invention, there is provided an ignition wire having a ferrite core, a coiled wire surrounding the core, and an insulating sheath surrounding both the core and the wire, where the coiled wire has a diameter of 0.07-0.11 mm, 110-180 turns per inch, and is comprised of a CuNi-based alloy.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
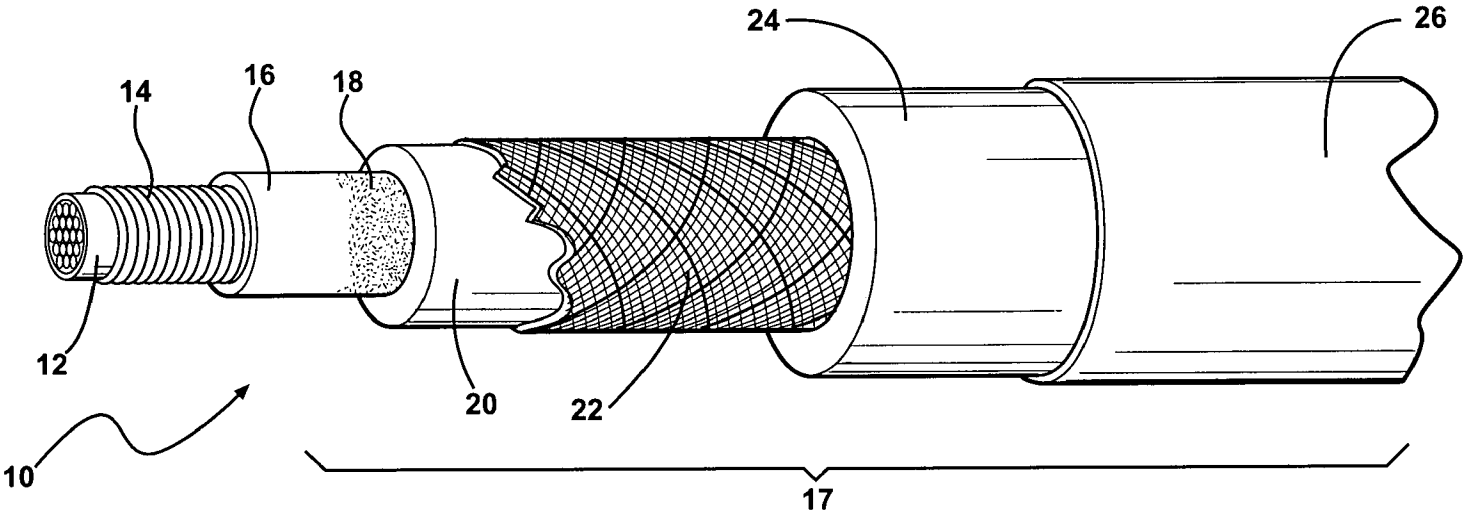
FIG. 1 is a perspective cutaway view of an embodiment of the ignition wire of this invention showing the various constituent layers of the wire.
Figure 2:
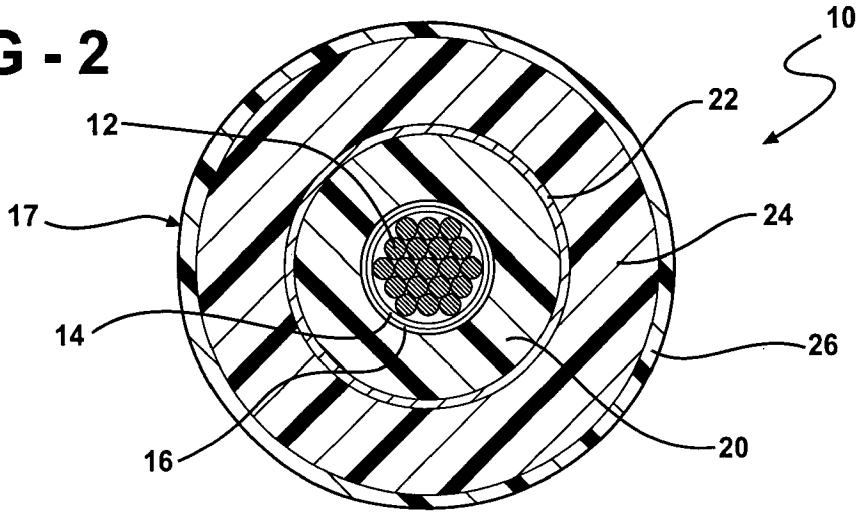
FIG. 2 is a cross-sectional view of the high voltage ignition wire of FIG. 1.

With reference to FIGS. 1 and 2, there is shown an ignition wire 10 which is capable of transmitting high voltage ignition pulses, including pulses of greater than 50,000 volts. Although the illustrated embodiment is directed to an ignition wire for vehicular internal combustion engines and various non-vehicular internal combustion engines, other embodiments of this invention can be used to supply electrical current to industrial igniters used in applications such as furnaces, dryers, or boilers, or to supply electrical current in aircraft ignition systems or any other application that requires delivery of a high voltage ignition pulse.

Ignition wire 10 exhibits a high inductance and a low resistance, and is preferably used and particularly suited to transmit high voltage ignition pulses from a vehicle ignition system to a spark plug. The high inductance of the ignition wire reduces the amount of radio frequency interference (RFI) emitted, while its low electrical resistance reduces energy losses experienced during transmission of the voltage pulses. Ignition wire 10 can be provided in a variety of sizes and generally includes an elongated ferrite core 12, a coaxially wound coiled wire 14, and an insulating sheath 17.

Ferrite core 12 increases the electromagnetic inductance of ignition wire 10 such that the amount of RFI produced by the wire during the transmission of high voltage pulses is reduced. The ferrite core is an elongated, wire-shaped component that extends along the longitudinal axis of ignition wire 10, and preferably includes a core stranding in the center surrounded by a core coating. According to a preferred embodiment, the core stranding is made of braided or woven Kevlar® made by E.I. du Pont de Nemours and Company, although other materials such as braided or woven fiber glass may also be used. The core stranding has a diameter of about 0.9 mm (±0.09 mm). The core coating is preferably made from a ferrite slurry having a high magnetic permeability that helps to increase the inductance of the ignition wire, and is applied to and infiltrates the core stranding such that ferrite core 12 has an overall diameter of about 1.25 mm (±0.125 mm). As an example, the ferrite core coating can include, by weight, about 5.0-8.4% carbon, 31.7-37.8% oxygen, 1.5-1.7% copper, 0.6-0.8% aluminum, 0.1-0.2% sulfur, 7.0-11.6% zinc, 2.4-3.3% nickel, and the balance iron and minor amounts of impurities. A suitable material for ferrite core 12 is sold by Jelliff Corporation, LGM Division (www.jelliff.com).

Coiled wire 14 conducts the high voltage ignition pulses carried by ignition wire 10, and is wound around ferrite core 12 such that the two components are generally coaxial. According to a preferred embodiment, coiled wire 14 has the following physical, compositional and configuration characteristics. Firstly, coiled wire 14 is preferably made of a CuNi-based alloy having, by weight, about 80-95% Cu and 5-20% Ni; even more desirably, the CuNi-based alloy includes about 86-90% Cu and 10-14% Ni; and most desirably, the CuNi-based alloy is a binary alloy that includes about 88% Cu and 12% Ni. However, the term "CuNi-based alloy" broadly includes any alloy composition including both copper (Cu) and nickel (Ni), even those having equal amounts of copper and nickel, those having more nickel than copper, and those having additional constituents. Secondly, coiled wire 14 preferably is a helical-shaped element that is coaxially wound around ferrite core 12 such that it generally surrounds the core along its length. According to a preferred embodiment, coiled wire 14 includes about 110 to 180 coils or turns/inch; even more desirably, it includes about 130 to 160 turns/inch; and most desirably, the coiled wire includes about 150 turns/inch. Thirdly, coiled wire 14 is comprised of wire that has a diameter of about 0.07-0.11 mm; even more desirably, the coiled wire diameter is about 0.08-0.10 mm; and most desirably, the diameter is about 0.09 mm. The design of ignition wire 10, including at least one or more of the three characteristics described above, give the ignition wire a combination of advantageous attributes; namely, low electrical resistance and high electromagnetic inductance. A conductive coating 16, which has little or no effect on the resistance of coiled wire 14 yet holds the coiled wire in place, is disposed over and surrounds the coiled wire. A suitable conductive coating is Durabond WC2193 made by Key Polymer (www.keypolymer.com), but other types of conductive coatings could be used, such as a conductive latex material which includes graphite. A thin release agent coating 18 is then disposed over the conductive coating to allow and enable separation between the conductive coating and insulating sheath 17 in the event that an end of the insulating sheath 17 of ignition wire 10 needs to be stripped.

Insulating sheath 17 surrounds, protects and insulates ferrite core 12 and coiled wire 14 from the outside environment. The sheath 17 preferably includes an insulation layer 20, a braiding layer 22, a jacket 24 and a coating layer 26. All of these layers are generally coaxial with each other and extend along the longitudinal axis of ignition wire 10. Insulation layer 20 is the radially-innermost layer of sheath 17 and provides a semi-conductive insulating layer that surrounds and protects ferrite core 12 and coiled wire 14. The insulation layer can be made of a silicone or a silicone-containing substrate, but could alternatively be made of other insulating thermoplastic polymer materials known to those skilled in the art. Surrounding the insulation layer is braiding layer 22, which gives the ignition wire tensile strength. It is preferably made of a natural glass fiber yarn with a standard basket weave of 8.5 P.P.I., but other fibers and weaves can of course be used. Jacket layer 24 is disposed over and surrounds braiding layer 22 such that it protects ignition wire 10 against tearing, abrasion and heat. An example of an appropriate jacket layer material is a silicone compound with a peak operating temperature that is greater than 600° Fahrenheit, but other jacket materials can also be used. Furthermore, the jacket layer 24 has an outer surface which can be finished using a variety of techniques to get a desired exterior cosmetic appearance. Lastly, coating layer 26 is applied over jacket layer 24 and further gives the wire a glossy and aesthetically pleasing outer surface appearance. The coating layer is a about one micron thick and can be made of a transparent silicone-based coating.

During manufacture, ferrite core 12 is made by dipping the core stranding in a ferrite slurry which, when it dries, becomes the core coating. Coiled wire 14 is then wound around ferrite core 12 by a conventional winding process to produce coiled wire 14. Once wound, the coiled wire 14 is coated with the conductive coating 16 and the release agent 18. Turning now to insulating sheath 17, insulation layer 20 is first extruded over core 12, coiled wire 14 conductive coating 16 and release agent coating 18 by a conventional extruding process. Following this step, braiding layer 22 is then braided over insulation layer 20 according to a conventional braiding operation. Next, jacket 24 is extruded over braiding layer 22, also by a conventional extruding process, and lastly coating layer 26 is chemically bonded to jacket 24 by a chemical grafting process as set forth in commonly owned, co-pending patent application Ser. Nos. 11/174,826 filed on Jul. 5, 2005 and 11/175,058 filed on Jul. 5, 2005, which are hereby incorporated by reference herein in their entirety. This completes the general assembly of ignition wire 10, after which, the ignition wire is cut to a suitable length and an axial end (not shown) is stripped to reveal about 15 mm of exposed core 12 and coiled wire 14. This exposed wire is then folded back over insulating sheath 17 and stapled to hold it in place. An appropriate electrical terminal is attached to the stripped and stapled ignition wire end and a conventional boot is fitted over the terminal. The exact terminals and boots used will be dictated by the specific application. For instance, ignition wire ends adapted to connect to a spark plug will differ from those intended to connect to an ignition coil.

In use, ignition wire 10 transmits high voltage ignition pulses from a vehicle ignition system to a spark plug, and does so with a reduced amount of electrical resistance and an increased amount of electromagnetic inductance relative to that of many prior art ignition wires. The design of the ignition wire of this invention, and in particular the characteristics of ferrite core 12 and coiled wire 14 described above, cause ignition wire 10 to exhibit an electrical resistance that is preferably between about 130 ohms/ft to 210 ohms/ft, and even more desirably between about 150 ohms/ft to 190 ohms/ft, and most desirably about 170 ohms/ft. The design of the ignition wire of this invention and particularly characteristics of ferrite core 12 and coiled wire 14 described above also cause ignition wire 10 to exhibit an electromagnetic inductance that is preferably between about 44-104 μH, and even more desirably about 70 μH. The electromagnetic inductance varies as the square of the number of coils or turns per inch.

It will thus be apparent that there has been provided in accordance with the present invention an ignition wire which achieves the aims and advantages specified herein, particularly those pertaining to low electrical resistance and high electromagnetic inductance. It will of course be understood that the foregoing description is of preferred exemplary embodiments of the invention and that the invention is not limited to the specific embodiments shown. Various changes and modifications will become apparent to those skilled in the art and all such variations and modifications are intended to come within the scope of the appended claims.

As used in this specification and appended claims, the terms "for example," "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that necessarily requires a different interpretation.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. An ignition wire, comprising:

an elongated ferrite core exhibiting a high magnetic permeability; a coiled wire surrounding said ferrite core, wherein said coiled wire (i) has a diameter of 0.07-0.11 mm, (ii) comprises 110-180 turns/inch, and (iii) comprises a CuNi-based alloy; and an insulating sheath surrounding said coiled wire;

wherein said ignition wire exhibits a resistance of 130-210 ohms/ft.

2. The ignition wire of claim 1, wherein said ignition wire exhibits a resistance of about 170 ohms/ft.

3. The ignition wire of claim 1, wherein said coiled wire has a diameter of about 0.09 mm.

4. The ignition wire of claim 1, wherein said coiled wire comprises about 150 turns/inch.

5. The ignition wire of claim 1, wherein said CuNi alloy consists essentially of about 88% Cu and about 12% Ni.

6. The ignition wire of claim 1, wherein said ferrite core includes an outer core coating comprising, by weight, 5.0-8.4% carbon, 31.7-37.8% oxygen, 1.5 1.7% copper, 0.6 0.8% aluminum, 0.1-0.2% sulfur, 7.0 11.6% zinc, 2.4-3.3% nickel and the balance iron and impurities.

7. The ignition wire of claim 1, wherein said ferrite core comprises a ferrite-based coating disposed over a core stranding.

8. The ignition wire of claim 1, wherein said ignition wire exhibits an electromagnetic inductance of 40-104 μH.

9. The ignition wire of claim 1, wherein said ignition wire exhibits an electromagnetic inductance of about 70 μH.

* * * * *

UNITED STATES PATENT AND TRADEMARK OFFICE

CERTIFICATE OF CORRECTION

PATENT NO. : 7,282,639 B2
APPLICATION NO. : 11/295957
DATED : October 16, 2007
INVENTOR(S) : Phillip Farmer It is certified that error appears in the above-identified patent and that said Letters Patent is hereby corrected as shown below:

Abstract, 11th line: After “31.7-37.8” add -- % --
Abstract, 13th line: After “2.4-3.3” add -- % --
Column 3, Line 49: Replace “layer is a about” with -- layer is about --
Column 6, Line 1: Replace “1.5 1.7%” with -- 1.5 - 1.7% --
Column 6, Line 2: Replace “7.0 11.6%” with -- 7.0 - 11.6% --

Signed and Sealed this

Sixth Day of May, 2008

JON W. DUDAS
*Director of the United States Patent and Trademark Office*